US005149159A

United States Patent [19]

Bardes

[11] Patent Number: 5,149,159

[45] Date of Patent: Sep. 22, 1992

[54] DISPOSABLE COLLECTOR AND CONTAINER

[76] Inventor: Dale L. Bardes, 1113 W. Albion Ave., Chicago, Ill. 60626-4613

[21] Appl. No.: 658,972

[22] Filed: Feb. 21, 1991

Related U.S. Application Data

[63] Continuation of Ser. No. 377,019, Jul. 7, 1989, abandoned.

[51] Int. Cl.[5] ..... A01K 29/00

[52] U.S. Cl. ..... 294/1.3; 294/25

[58] Field of Search ..... 294/1.3-1.5, 294/25; 2/161 R, 168; 15/104.8, 257.1, 257.6, 227

[56] References Cited

U.S. PATENT DOCUMENTS

| | | | |
|---|---|---|---|
| 1,713,065 | 5/1929 | Williams | 15/227 |
| 2,736,052 | 2/1956 | Tufarolo | 15/227 |
| 3,608,708 | 9/1971 | Storandt | 15/227 X |
| 4,214,321 | 7/1980 | Nuwayser | 2/161 R X |
| 4,515,841 | 5/1985 | Dyke | 294/1.3 X |
| 4,768,818 | 9/1988 | Kolic | 294/1.3 |
| 4,788,733 | 12/1988 | Lerner | 294/1.3 X |
| 4,845,781 | 7/1989 | Strickland et al. | 294/1.3 X |
| 4,902,283 | 2/1990 | Rojko et al. | 294/1.3 X |

*Primary Examiner*—Margaret A. Focarino
*Assistant Examiner*—Dean J. Kramer
*Attorney, Agent, or Firm*—Frost & Jacobs

[57] ABSTRACT

A disposable device for the manual collection and containment of small amounts of material without direct manual contact. The device comprises an elongated bag of flexible, moisture-proof material having an open end and a closed end. The bag is so sized as to comfortably receive the user's hand. The closed end of the bag is two ply with a thin layer of air therebetween for puncture resistance and is gusseted to have a "W"-shape in cross-section. This gusseting provides two interior pockets for the receipt of the user's fingers and thumb, respectively, and an intermediate exterior pocket to receive the collected material which is picked up by opposing forces applied thereto by the user's fingers and thumb. Once the material to be collected is engaged in the intermediate exterior pocket, the user employs his free hand to strip the bag from his occupied hand by engaging the open end of the bag with his free hand and pulling it forwardly of his occupied hand, turning the bag inside-out and completely enclosing the collected material. The elongated body of the bag can be tied in a knot or provided with an apropriate tying or sealing means.

19 Claims, 3 Drawing Sheets

DISPOSABLE COLLECTOR AND CONTAINER

This is a continuation of application Ser. No. 07/377,019, filed Jul. 7, 1989, now abandoned.

TECHNICAL FIELD

The invention relates to a disposable collector and container in the form of a glove-like bag, and more particularly to such a collector and container which takes full advantage of manual dexterity in picking up the material to be collected, while preventing direct manual contact.

BACKGROUND ART

The collector and container of the present invention can be used whenever a small object or a small amount of material is to be collected and contained without direct manual contact. For example, it could be used in law enforcement to collect and contain evidentiary material. It could be used in the collection and handling of sterilized equipment and materials, food items such as bakery goods and the like. The device of the present invention also provides a safe, practical, inexpensive means to pick up and contain undesirable waste material. For example, it can be used in the removal and containment of automotive oil filters, paint rollers and the like. It can be used to collect and contain small dead animals such as mice, birds, etc. An important application of device of the present invention is the collection and containment of infectious and hazardous waste in medical, autopsy, and mortuary applications. The device can similarly be used for the collection and containment of organs, tissue, and the like to be tested.

A frequently encountered application for a device to pick up undesirable waste is in the collection and containment of pet feces. Many municipalities have ordinances requiring pet owners to be responsible for their pet's waste. Although clearly not intended to be so limited, the collector and container of the present invention will be described, for purposes of an exemplary showing, in its application to the collection and containment of pet waste.

Typically, prior art means for this purpose simply constitute mechanical devices forming an extension of the user's hand. For example, U.S. Pat. No. 3,978,540 teaches a disposable pick-up container for animal litter utilizing two opposed cardboard scoops located at the open end of a bag. U.S. Pat. No. 4,752,093 teaches a ramp like element having a bag in association therewith. The animal waste is shifted onto the ramp by a disposable scoop or manually by inserting a hand in a pocket-like structure formed in the side of the bag. Thereafter, the bag is pulled over the ramp and sealed. U.S. Pat. No. 4,741,565 teaches a shovel-like structure having a handle for the operator's hand. The structure is provided with a bag which is pulled over the operator's hand during use. Once the shovel has been filled, the bag is pulled over the shovel, itself, and sealed. U.S. Pat. No. 3,739,418 teaches a flexible paper or plastic bag having a pair of opposed scoop panels secured adjacent its open end. Upon engaging the litter with the scoop panels, the bag is inverted to cause the litter to enter the bag. Thereafter, the panel scoop members are turned inwardly to seal the bag and form a carrying handle therefor.

The above-noted patents are exemplary of those relating to disposable waste collectors. The prior art disposable waste collectors have certain common features. For example, they normally require two hands, or one hand and another object in order to operate. They lose flexibility and dexterity by using mechanical devices constituting extensions of the human hand. They incorporate supplemental devices for putting the waste into the container. They generally rely on the waste being of consistent size and texture and that the waste is to be picked up from a smooth surface. Finally, they employ a horizontal movement to pick up the waste.

As is well known, if an object is to be picked up by a mechanical device, opposing forces must be applied to that object. Opposing forces can be in the form of two pieces of cardboard working against one another; a scoop moving the waste object onto another object; or a shovel-like device pushing the waste object against a restraining object.

The present invention is based upon the discovery that numerous advantages accrue from the use of the human hand to provide necessary opposing forces to pick up an object. To this end, the collector and container of the present invention constitutes a hygienic, inexpensive, glove-like bag to protect the thumb and fingers of the user as they apply the opposing forces to pick up the object. As a result, use of the collector and container of the present invention requires only one hand, leaving the other hand free for other functions. The collecting operation is controlled by the sense of touch and unequalled dexterity of the human hand so that objects of varying size and consistency can be collected, even from entangling surfaces such as grass or the like. The material to be collected can be approached from any direction and at any angle including vertically, and is not restricted to a horizontal scooping action. These advantages provide the collector and container of the present invention with the wide variety of applications (some of which were enumerated above), so that it is not restricted to use as a pet waste collector and container. When employed as a pet waste collector and container, however, it is far simpler and easier to use than prior art devices. Furthermore, it enables handicapped persons to care for their pets or guide dogs.

DISCLOSURE OF THE INVENTION

According to the invention there is provided a disposable device for the manual collection and containment of small amounts of material or small objects, without direct manual contact. The device comprises an elongated bag of flexible, moisture-proof material having an open end and a closed end.

The elongated bag-like collector and container is sized to receive the user's hand. At its closed end, the bag is provided with a gusset so as to have a "W"-shape in cross-section. This "W"-shaped gusseting provides two interior pockets and one intermediate exterior pocket. One of the interior pockets is adapted to accommodate the user's fingers. The other of the interior pockets is adapted to receive the user's thumb. The exterior pocket, located between the two interior pockets, is adapted to receive the object or material to be collected. The elongated body of the collector and container is extended over the user's hand and arm to protect the user and the user's clothing.

Once the material to be collected is located in the intermediate exterior pocket and engaged by the opposing forces of the user's fingers and thumb, the user may employ his other hand to strip the bag from the occupied hand by grasping the open end of the bag and pulling it forwardly over his occupied hand, thus turning the bag inside-out and completely enclosing and containing the collected material.

Thereafter, the elongated body of the bag may be tied in a knot, or the open end of the bag may be provided with appropriate tying or sealing means.

In the preferred embodiment, the closed end of the collector and container, including the "W"-shaped gusset, is of two-ply construction as will be described hereinafter. As will also be described hereinafter, in some instances it may be desirable to make the collector and container device of a biodegradable and photodegradable material.

DETAILED DESCRIPTION OF THE INVENTION

Figure 2:
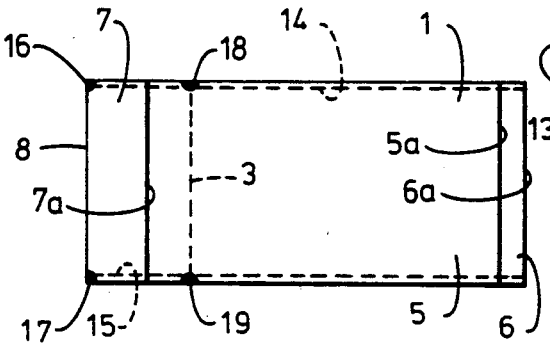
FIG. 2 is a plan view of the disposable collector and container of the present invention.

The glove-like collector and container of the present invention is preferably made of a continuous strip of thin, flexible, moisture proof, vapor proof, and odor impervious material. The continuous strip 1 is folded back upon itself, as is diagrammatically indicated in FIG. 1. It will be appreciated that in FIG. 1 and the other figures, the thickness of the material 1 is exaggerated. At what will ultimately be the closed end of the collector and container, the strip 1 is folded along transverse fold lines 2, 3, and 4 forming a gusset having a "W"-shape. In the diagrammatic representation of FIG. 1, the sides 5 and 6 of the collector and container have not yet been joined together at their edges and are shown spaced from each other so that the "W"-shape of the closed end gusset can be more clearly represented. The end edges of strip 1 are shown at 5*a* and 6*a*.

In the preferred embodiment of the structure, the closed gusseted end is provided with a second ply 7 of thin, flexible, moisture proof material. It will be noted that the second ply 7 is folded along transverse fold lines 8, 9 and 10 to achieve the same "W"-shaped, gusseted configuration. The second ply 7 is of the same width as the first ply 1, but it extends only a short way along the collector and container sides 5 and 6. The end edges of strip 7 are shown at 7*a* and 7*b*.

Figure 1:
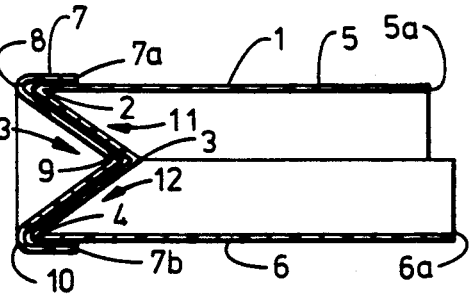
FIG. 1 is a simplified, diagramatic, edge elevational view of the sheet material from which the disposable collector and container of the present invention is made, the sheet material being partially folded prior to welding.

As is evident from the diagrammatic representation of FIG. 1, the closed, gusseted end of the collector and container forms three pockets. Two interior pockets are generally indicated at 11 and 12, while an intermediate exterior pocket is generally indicated at 13. The purpose of these pockets will be apparent hereinafter.

The material from which strips 1 and 7 are made can vary, depending upon the application to which the collector and container is directed. Preferably, strips 1 and 7 are made of thin, flexible, moisture proof plastic material. While not necessarily so limited, the strips 1 and 7 can be made of polyvinyl chloride (PVC), or ethylene vinyl acetate (EVA). Both materials are well known in the art and are readily available. It is preferable that strip 1 has a thickness falling in the range of from about 0.07 mils to about 1.25 mils. As will be further described hereinafter, it is preferred that strip 7 be somewhat thicker, falling in the range of from about 1 mils to about 2 mils.

Again, depending upon the use to which the collector and container is directed, the plastic material from strips 1 and 7 are made may be non-degradable or degradable. Plastics generally are made of polymers, which are long chains of repeating hydrocarbon molecules so tightly bound together that micro-organisms, fungus, and bacteria which normally dissolve wood, paper and other organic matter, cannot penetrate.

Biodegradable plastics have been developed wherein the polymer chains are modified by inclusion of other polymers vulnerable to micro-organisms that destroy the polymer chain. Eventually, the fragments become small enough that they can be eaten by the micro-organisms.

In order to minimize the environmental damage which is currently being experienced with landfill disposal, it is within the scope of the invention to incorporate a chemical coating on the central exterior pocket 13 to facilitate decomposition of encapsulated material and/or to provide an air freshening scent. To further minimize environmental damage, the bag-like collector and container may be constructed of a material that is both photodegradable and biodegradable.

When the collector and container of the present invention is used to handle infectious and hazardous waste from medical applications and the like, then it would be preferred that the material from which strips 1 and 7 are made be non-degradable. Furthermore, the material can be color-coded for public health requirements, if desired or required.

Returning now to FIG. 2, this figure illustrates in plan view the strips or plys 1 and 7 laid up together and flattened upon each other. In FIG. 2, the end edge 7*a* of strip 7 is shown, together with the fold line 8 of strip 7. Those portions 5 and 6 of strip 1 forming the sides of the collector and container are also shown, together with their end edges 5*a* and 6*a*. While the end edges 5*a* and 6*a* may overlie each other, in the embodiment illustrated in FIGS. 1 and 2, side portion 6 is shown slightly longer than side portion 5 for ease of handling and ease of opening the open end of the bag-like collector and container. Finally, in FIG. 2, the fold line 3 of strip 1 is shown in broken lines.

Once the strips 1 and 7 have been laid up as shown in FIG. 2, their longitudinal edges can be joined together by any appropriate means. When strips 1 and 7 are made of plastic material, a preferred method of joining the longitudinal sides together is by heat welding or the like, as is indicated by broken lines 14 and 15. While not required, it is preferred that reinforcing welds 16 and 17 be applied at the forwardmost corners of the structure together with reinforcing welds 18 and 19 located on the longitudinal edges of the structure at the juncture of fold 3 of strip 1 and fold line 9 of strip 7 therewith.

Figure 3:
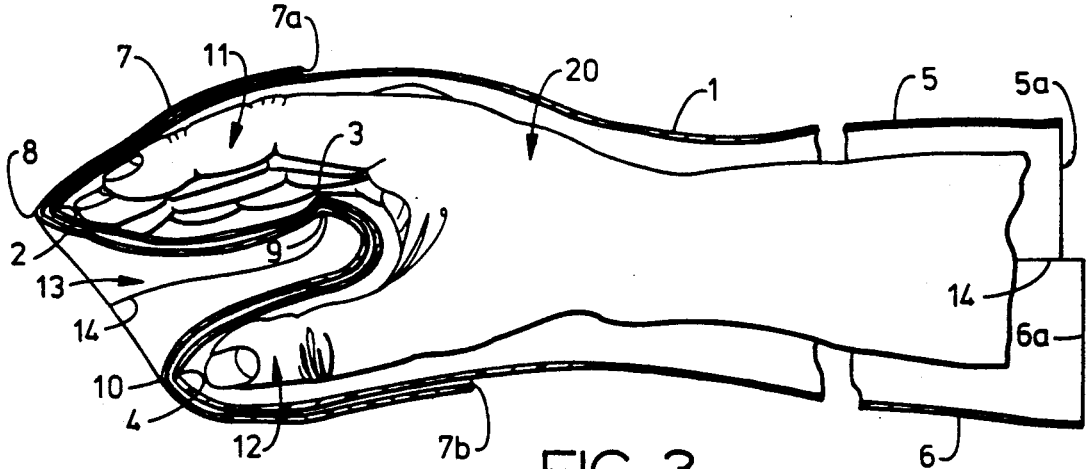
FIG. 3 is a fragmentary, longitudinal, cross-sectional view of the disposable collector and container with the user's hand positioned therein.
Figure 5:
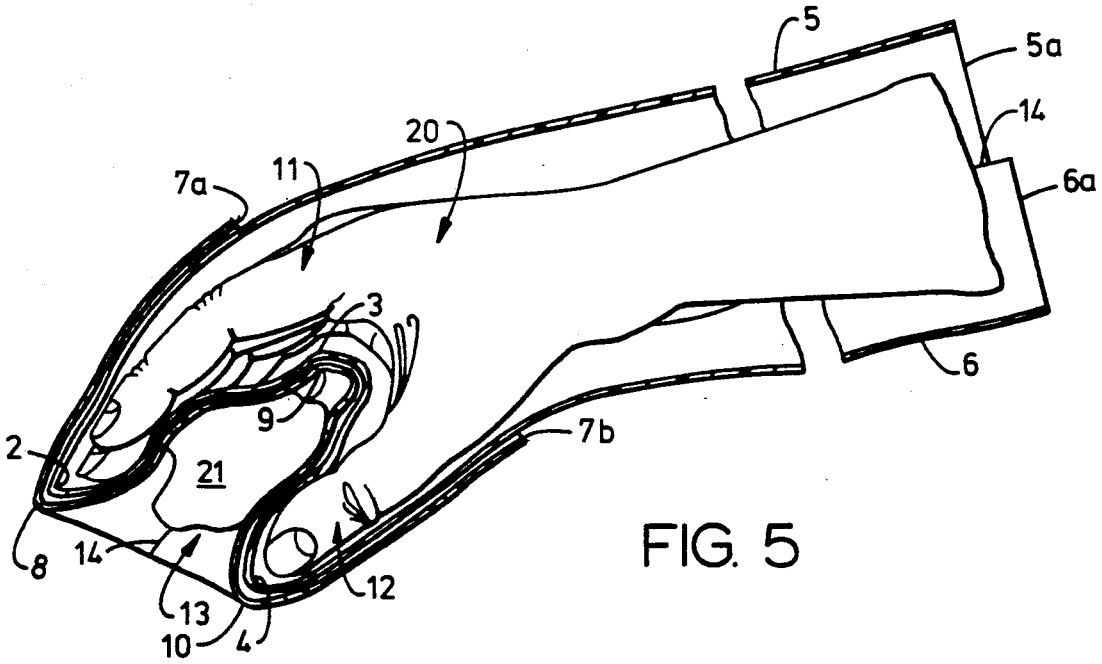
FIG. 5 is a fragmentary cross-sectional view similar to FIG. 3 illustrating material being picked up by the collector and container.
Figure 8:
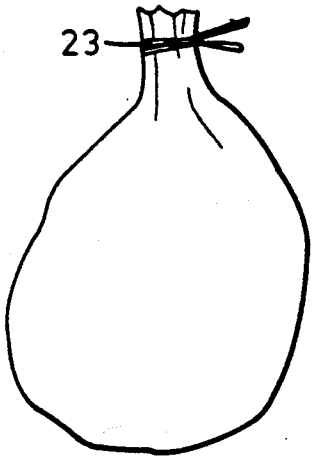
FIG. 8 illustrates the disposable collector and container with its open end closed by a tie device.
Figure 4:
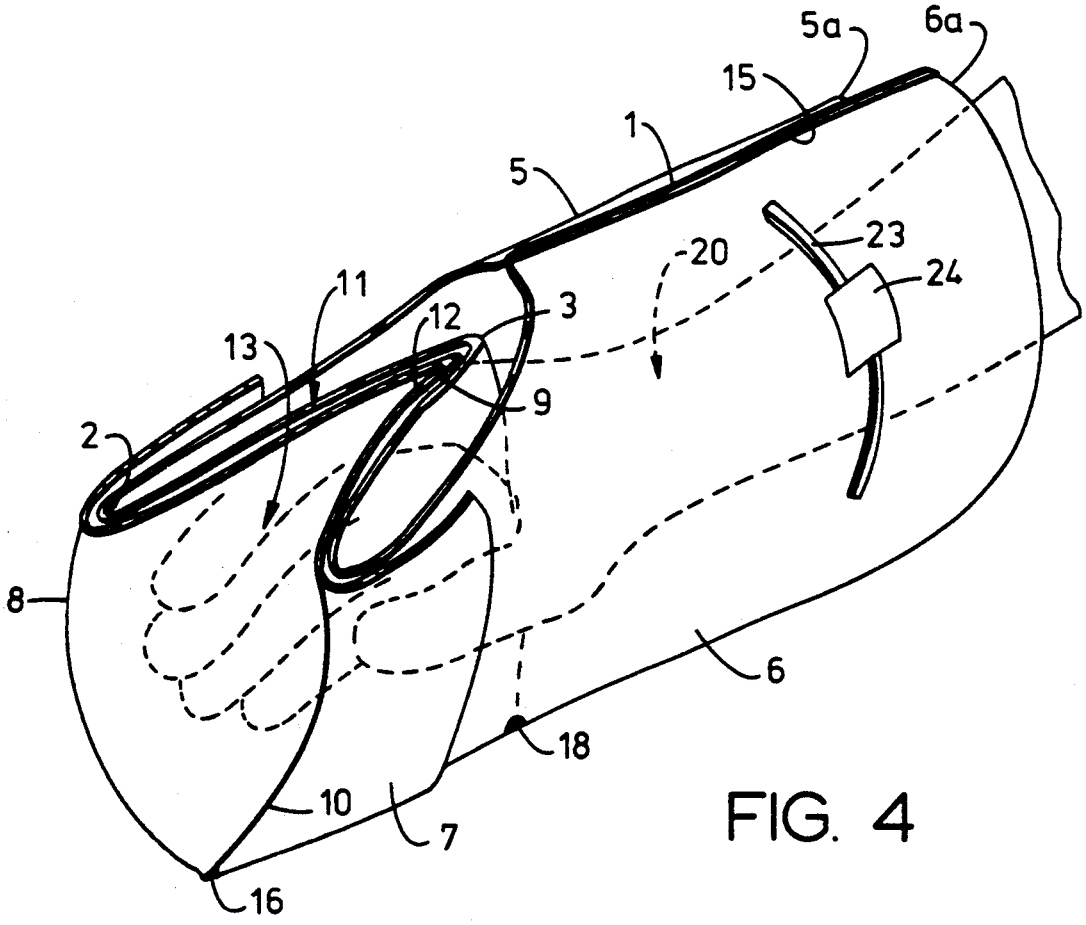
FIG. 4 is a fragmentary perspective view of the disposable collector and container with the user's hand located therein and with a forward corner of the collector and container broken away.

In FIGS. 3 and 4, the bag-like collector and container of the present invention is illustrated with the user's hand (generally indicated at 20) located therein. Again, like parts have been given like index numerals. It will be evident from these figures that one of interior pockets 11 and 12 is intended to receive the fingers of the operator, while the other of interior pockets 11 and 12 is intended to receive the operator's thumb. The intermediate exterior pocket 13 is located between the operator's fingers and thumb so that an opposed, grasping force can be applied to both sides of exterior pocket 13 to engage the material to be collected therein. This is illustrated in FIG. 5, wherein like parts have again been given like index numerals. To collect the material 21 of interest, the user simply shifts his thumb away from his fingers. This opens the exterior pocket 13. Thereafter, the user approaches the material 21 to be collected from any convenient angle and direction, locating the exterior pocket 13 thereabout. By closing his fingers and thumb toward each other, the operator applies a grasping force to the sides of exterior pocket 13 and against the material 21 being collected so that the material 21 can be grasped and removed from the surface upon which it was located. If necessary, the user can direct his hand 20 upwardly to assure that the material 21 is fully seated within exterior pocket 13. This operation can be repeated as necessary. At this stage, the collecting step of the operation is completed.

As indicated above, in the preferred embodiment, the closed end of the collector and container is provided with a second ply or strip 7 of heavier gage. In addition, the strip 7 is preferably embossed. This not only increases the structural strength of the outside pocket 13, it also minimizes the thermal and texture distastefulness associated with picking up undesirable waste.

It will be remembered that strip 7 is joined with strip 1 only along the longitudinal edges of the bag-like collector and container, at weld lines 14 and 15. There is no joinder of the two plys along the end edges **7*a* and 7*b* of strip 7. Therefore, a thin layer of air exists between strip 1 and strip 7. The embossing of strip 7 further assures the existence of this thin air layer between the plys. If a surface abrasion is encountered during collection of the material of interest, lateral movement between the plys will result, rather than a rupturing of either of the plys. The existence of the air layer further reduces friction between the plys. The air layer further reduces the thermal and texture distastefulness mentioned above. Finally, the embossing of the strip 7** provides a textured surface enhancing the gripping of the material to be collected.

Figure 7:
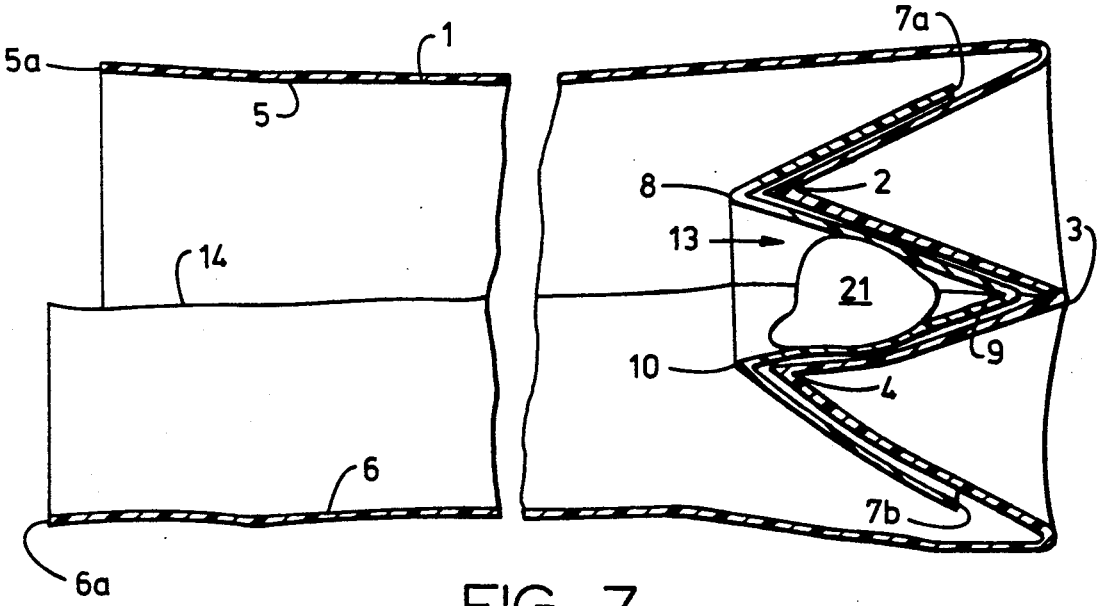
FIG. 7 is a fragmentary cross-sectional view illustrating the collector and container fully turned inside-out with the collected material contained therein.

When the material has been picked up, as shown in FIG. 5, it can be transferred to another container. Alternatively the collector and container, itself, can be used to encapsulate the material 21. To this end, the user's free hand 22 is used to engage the bag-like collector and container at its rearward or open end. Once so engaged, the operator's free hand is used to pull the open or rearward end of the collector and container forwardly of the occupied hand 20, turning the bag-like collector and container inside out. This not only removes the structure from the operator's hand 20, but also fully contains the collected material 21 as shown in FIG. 7.

Figure 6:
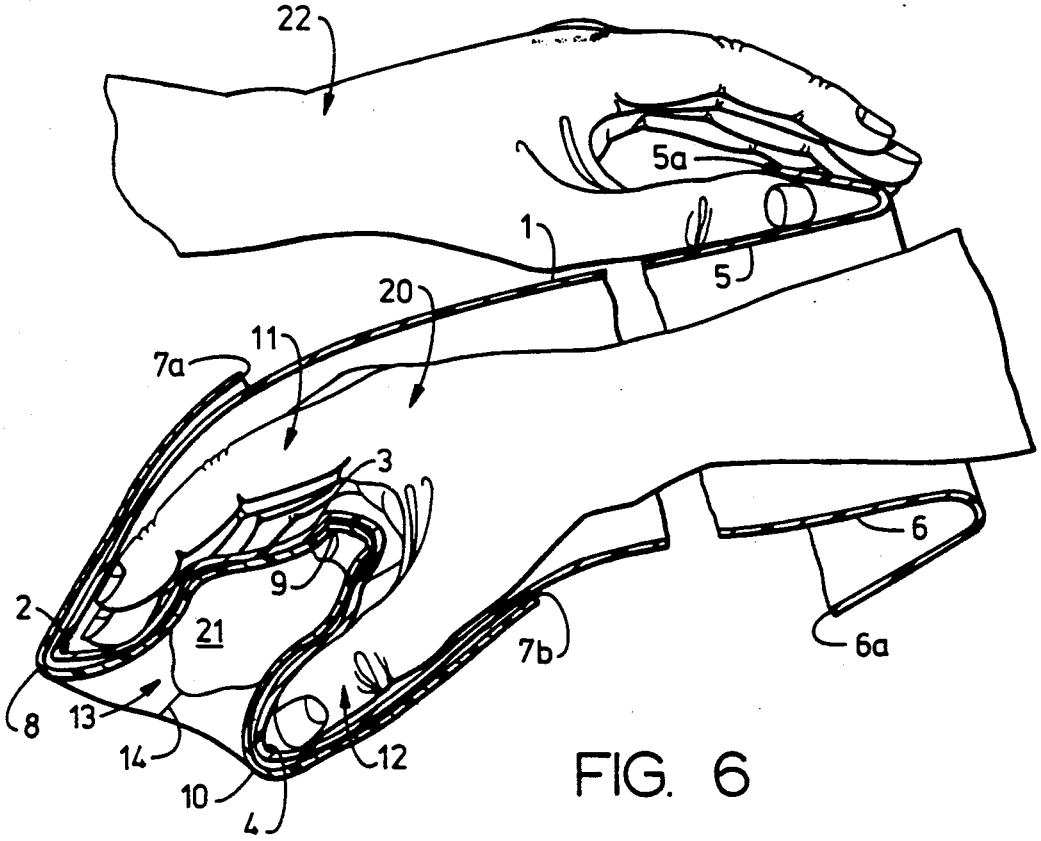
FIG. 6 is a fragmentary cross-sectional view, similar to FIG. 5, and showing the collector and container being turned inside-out.

At this stage, the only remaining step to complete the collecting and containing procedure is the closing of the open end of the bag-like collector and container. The manner in which the open end of the bag-like collector and container is closed does not constitute a limitation of the present invention. For example, the collector and container may come with a plastic or wire reinforced tie 23 affixed thereto by a small piece of tape 24 (see FIG. 4). The tie 23 may be used to close the open end of the collector and container, as shown in FIG. 6. Other means may be used to close the collector and container. For example, the elongated body of the collector and container may simply be tied in an overhand knot. The structure may be provided with a drawstring or the sides 5 and 6 may have areas covered with adhesive which come into contact only after the structure has been turned inside out.

Modifications may be made in the invention without departing from the spirit of it.

What is claimed is:

1. A disposable collector and container for the manual collection and containment of small amounts of material and small objects without direct manual contact, said collector and container comprising an elongated bag-like structure of thin, flexible, moisture-proof material having an open end, a closed end, and closed side edges, said bag being sized to comfortably receive the user's hand, said closed end being gusseted to form a "W"-shape in cross section, a second exterior ply of thin, flexible, moisture-proof material at and overlying said closed end of said collector and container, said second ply being gusseted to have a corresponding "W"-shape in cross section, said second ply comprising the exterior ply when said collector and container is right side-out, said second ply being attached to said collector and container in such a way that a thin layer of air exists therebetween, reducing friction between said collector and container and said exterior ply and enhancing movement therebetween, said attachment of said outer ply and said thin layer of air comprising means for enabling controlled movement between said exterior ply and said container and collector to enhance puncture resistance thereof, said gussets in said closed end and second exterior ply forming two interior pockets for receipt of the user's fingers and thumb, respectively, and an intermediate exterior pocket therebetween for receipt of the material being collected and for engagement thereof by and between said fingers and thumb, said collector and container when turned inside-out to remove it from the user's hand comprising a container for said collected material.

2. The collector and container claimed in claim 1 including means to close said open end when said collector and container is turned inside-out.

3. The collector and container claimed in claim 1 wherein said collector and container comprises a single strip of thin, flexible, moisture-proof plastic of uniform width and having first and second longitudinal side edges and first and second ends, a first portion of said strip comprising a first side of said bag-like collector and container and extending from said first strip end to a first fold line directed transversely of said strip, a second portion of said strip overlying said first strip portion and extending from said first fold line to a second fold line directed transversely of said strip, a third portion of said strip overlying said second portion, being coextensive therewith, and extending from said second fold line to a third fold line directed transversely of said strip and overlying said first fold line, a fourth portion of said strip extending from said third fold line to said second end of said strip and overlying said first, second and third strip portions, said fourth strip portion being at least coextensive with said first strip portion and constituting the second side of said bag-like collector and container, said first, second and third fold lines defining said gusset and creating said "W"-shaped cross section, said second ply of thin, flexible, moisture-proof material having the same uniform width as said single strip and having first and second longitudinal side edges and first and second ends, a first portion of said second ply extending from said first end of said second ply to a first transversely directed fold line in said second ply, said first portion of said second ply overlying exteriorly a part of said first portion of said single strip, said second ply having second and third portions defined between said first fold line and a second transversely directed fold line in said second ply and between said second fold line and a third transversely directed fold line of said second ply, respectively, said second and third portions of said second ply overlying and being coextensive with said second and third portions of said single strip, said first, second and third fold lines of said second ply being located adjacent said first, second and third fold lines of said single strip, respectively, said second ply having a fourth portion defined by said third fold line and said second end of said second ply and exteriorly overlying a part of said fourth portion of said single strip, said first, second and third fold lines of said second ply defining said gusset therein and creating said "W"-shaped cross section of said second ply corresponding to that of said single strip, the corresponding longitudinal edges of said single strip portions and said second ply portions being welded together throughout their lengths to form said bag-like collector and container with said two-ply closed and gusseted end, said second ply being otherwise unattached to said single strip allowing said thin layer of air to exist therebetween.

4. The collector and container claimed in claim 3 wherein said first and second ends of said single strip define said open end of said bag-like collector and container.

5. The collector and container claimed in claim 4 including means to seal said open end of said collector and container when turned inside-out.

6. The collector and container claimed in claim 3 including reinforcing welds at the juncture of said first and third folds of said single strip and said second ply with the longitudinal side edges of both said single strip and said second ply, and at the juncture of said second folds of said single strip and said second ply with the longitudinal side edges of both said single strip and said second ply.

7. The collector and container claimed in claim 3 wherein the thickness of said single strip is in the range of from about 0.075 mil to about 1.25 mils, said thickness of said second ply being in the range of from about 1 mil to about 2 mils.

8. The collector and container claimed in claim 3 wherein said plastic material of both said single strip and said second ply is degradable.

9. The collector and container claimed in claim 3 wherein said plastic material of both said single strip and said second ply is non-degradable.

10. The collector and container claimed in claim 3 wherein said plastic material of said second strip is embossed.

11. The collector and container claimed in claim 3 comprising a collector and container for pet waste.

12. The collector and container claimed in claim 3 comprising a collector and container for infectious and hazardous waste.

13. The collector and container claimed in claim 1 wherein said thin, flexible, moisture-proof material of said bag-like structure and said second ply is a plastic material chosen from the class consisting of polyvinyl chloride (PVC) and ethylene vinyl acetate (EVA).

14. The collector and container claimed in claim 1 comprising a collector and container for pet waste.

15. The collector and container claimed in claim 1 comprising a collector and container for infectious and hazardous waste.

16. The collector and container claimed in claim 1 wherein said second ply is embossed.

17. The collector and container claimed in claim 1 comprising a collector and container for sterilized items.

18. The collector and container claimed in claim 1 comprising a collector and container for food items.

19. The disposable collector and container claimed in claim 1 wherein said exterior ply is attached to said collector and container only along the side edges thereof.

* * * * *